US007180229B2

(12) United States Patent
Arndt et al.

(10) Patent No.: US 7,180,229 B2
(45) Date of Patent: Feb. 20, 2007

(54) HIGH PRESSURE DISCHARGE LAMP WITH A BASE AT ONE END

(75) Inventors: Joachim Arndt, Brieselang (DE); Uwe Fidler, Berlin (DE); Markus Herb, Gunzburg (DE)

(73) Assignee: Patent-Treuhand-Gesellschaft für electrische Glühlampen mbH, Munich (DE)

( * ) Notice: Subject to any disclaimer, the term of this patent is extended or adjusted under 35 U.S.C. 154(b) by 0 days.

(21) Appl. No.: 11/289,445

(22) Filed: Nov. 30, 2005

(65) Prior Publication Data

US 2006/0119245 A1 Jun. 8, 2006

(30) Foreign Application Priority Data

Dec. 6, 2004 (DE) ..... 10 2004 058 750

(51) Int. Cl.
*H01J 61/02* (2006.01)

(52) U.S. Cl. ..... 313/113; 313/110

(58) Field of Classification Search ..... 313/113, 313/110; 348/786; 359/614
See application file for complete search history.

(56) References Cited

U.S. PATENT DOCUMENTS 4,420,801 A * 12/1983 Reiling et al. ..... 362/297
4,799,135 A * 1/1989 Inukai et al. ..... 362/516
5,065,287 A * 11/1991 Staiger et al. ..... 362/518
5,144,190 A * 9/1992 Thomas et al. ..... 313/113
5,975,733 A * 11/1999 Gonzalez Gallegos et al. ..... 362/549
2002/0011767 A1* 1/2002 Zhou et al. ..... 313/113

FOREIGN PATENT DOCUMENTS

| | | |
|---|---|---|
| DE | 38 08 086 | 9/1989 |
| EP | 0 282 100 | 9/1988 |
| EP | 1 109 199 | 6/2001 |

* cited by examiner

*Primary Examiner*—Nimeshkumar D. Patel
*Assistant Examiner*—Matt Hodges
(74) *Attorney, Agent, or Firm*—William E. Meyer

(57) ABSTRACT

High-pressure lamp with a base, having an inner vessel sealed in a vacuum-tight manner, and surrounded by a sleeve part, a base having electrical terminals bearing, on one side, the inner vessel and, on the other side, the sleeve part, the reflector being of rotationally symmetrical design, and having a contour divided into at least two zonal layers, whose axial height is dimensioned such that each zone captures at least 35% of the light intensity emerging from the center of the inner vessel, and a first zone reflecting back at least 90% of the light incident on it at positive angles in relation to the lamp axis, and a second zone reflecting back at least 90% of the light incident on it at negative angles in relation to the lamp axis, and the inner vessel containing a metal halide filling, and the lamp having a specified average color temperature.

9 Claims, 11 Drawing Sheets

HIGH PRESSURE DISCHARGE LAMP WITH A BASE AT ONE END

TECHNICAL FIELD

The invention relates to a high-pressure discharge lamp with a base at one end in accordance with the precharacterizing clause of claim 1. Of particular concern here are high-pressure discharge lamps, preferably metal halide lamps, but also, for example, halogen incandescent lamps. In this case, an elongate, in particular ceramic, discharge vessel is often used as the lamp bulb.

PRIOR ART

EP-A 1 109 199 describes a high-pressure lamp with a base at one end, in which the outer bulb is surrounded by a reflector. The reflector contour is not divided up in any other way.

One disadvantage of this high-pressure lamp is the fact that color effects may result in the image when metal halide lamps are used in these conventional reflectors, owing to the filling condensate which is generally deposited at the bottom in the burner of the lamp. This effect is particularly marked in the horizontal operating position, the condensate acting as a color filter and being reproduced by a conventional reflector as a "yellow dot" with markedly lower color temperatures in the upper half of the projection plane.

DE 38 08 086 has already disclosed a reflector whose contour comprises various shaped sections, some of which represent free-form surfaces. This reflector is envisaged for use in vehicle headlights together with incandescent lamps. The concept of free-surface contours is explained, for example, in detail in EP-A 282 100.

SUMMARY OF THE INVENTION

One object of the present invention is to provide a lamp with a base at one end in accordance with the precharacterizing clause of claim 1 which, as far as possible, avoids color effects.

This object is achieved by the characterizing features of claim 1. Particularly advantageous refinements are described in the dependent claims.

In the case of conventional reflectors, only positive angles are produced. This means that, in relation to the lamp axis or its parallel, there are always only rays reflected back by the reflector contour which form positive angles with the axis, i.e. intersect the axis again in the far field.

If the reflector lamp is divided into four quadrants in the lateral section, which quadrants are formed by the lamp axis and the reflector opening, in the case of a conventional reflector, the quadrants are always assigned crosswise. In the horizontal operating position, this means that light from the lower half, i.e. by definition the second quadrant, irradiates the opposite half (in the imaging plane), by definition the fourth quadrant. Conversely, light from the upper half (first quadrant) of the lamp is assigned to the lower half (in the projection plane), i.e. the third quadrant. This clear assignment does however cause high color scattering in lamps which have a condensate as the filling. This is because the region which contains the condensate, i.e. generally always the lower quadrant in the horizontal operating position, thus receives its radiation only indirectly via the condensate, which colors the radiation yellow and thus creates a dot with a lower color temperature. The region which contains no condensate, i.e. generally always the upper quadrant in the horizontal operating position, obtains its radiation without any change, in this case the color temperature is markedly higher. With conventional measurements using an Ulbricht sphere, this problem is not indicated since the measurement in this case takes place integrally over the entire sphere and there is no local resolution.

According to the invention, the reflector is now contoured such that both zones obtain approximately half the light of each quadrant. In practice, this should be at least 35% instead of the optimum 50%. The first zone is calculated such that it sends the light into the quadrant which lies directly above it without intersecting the lamp axis. Only the second zone is calculated such that light assigned to it conventionally intersects the lamp axis and falls in the other quadrant of the projection plane. Averaging is thus achieved. In each case approximately half the radiation in one quadrant of the projection plane originates from the quadrant below on the emission side, and the other half originates from the opposite quadrant on the emission side. This compensating effect until now needed to be achieved incompletely and with great effort by a suitably patterned cover disk.

In detail, the lamp with a base at one end has an inner vessel which is sealed in a vacuum-tight manner, in particular an elongate discharge vessel made from ceramic or quartz glass, which is accommodated, under certain circumstances, in an outer bulb. It is irrelevant here whether the discharge vessel is cylindrical or round.

The inner vessel is also surrounded by a reflector. The inner vessel is preferably a unit comprising a discharge vessel with an outer bulb. It is particularly preferably a ceramic discharge vessel, in particular a metal halide lamp for general lighting purposes.

In this case, a base having electrical terminals bears, on the one hand, the inner vessel and, on the other hand, the reflector part. The electrical terminals are normally connected to power supply lines which produce an electrical contact with a luminous means in the interior of the inner vessel, which luminous means is implemented, for example, by electrodes in the interior. Without restricting the invention, outer electrodes may also be used, or an electrode-less configuration. Instead of a ceramic discharge vessel, a discharge vessel made from quartz glass or hard glass may also be used. An outer bulb as part of the inner vessel is not absolutely necessary, but is often desired.

In addition to the base insulator, the base has a conventional part facing the lampholder, for example a screw base attachment or a bayonet-type base attachment or GU base.

The inner vessel, i.e., for example, the lamp bulb or the outer bulb, which contains a discharge vessel, or the discharge vessel in the case where there is no outer bulb, is preferably held in the central opening by means of a spring clip, as is known per se.

Power supply lines are generally passed out of the lamp bulb and are connected to the electrical terminals of the base. A particularly flexible and time-saving solution consists in clamping connections being used for the connection between the electrical terminals and the power supply lines, as is known per se.

The base also generally has a part facing the lampholder, which is at least partially connected to the base insulator by means of crimping, as is known per se. This part contains, for example, a conventional screw thread or pin of a bayonet-type base etc.

A typical application is a metal halide lamp which contains a filling with or without a mercury content, possibly with an inert starting gas, advantageously a noble gas.

BRIEF DESCRIPTION OF THE DRAWINGS

The invention will be explained in more detail below with reference to a plurality of exemplary embodiments. In the drawing.

PREFERRED EMBODIMENT OF THE INVENTION

Figure 1:
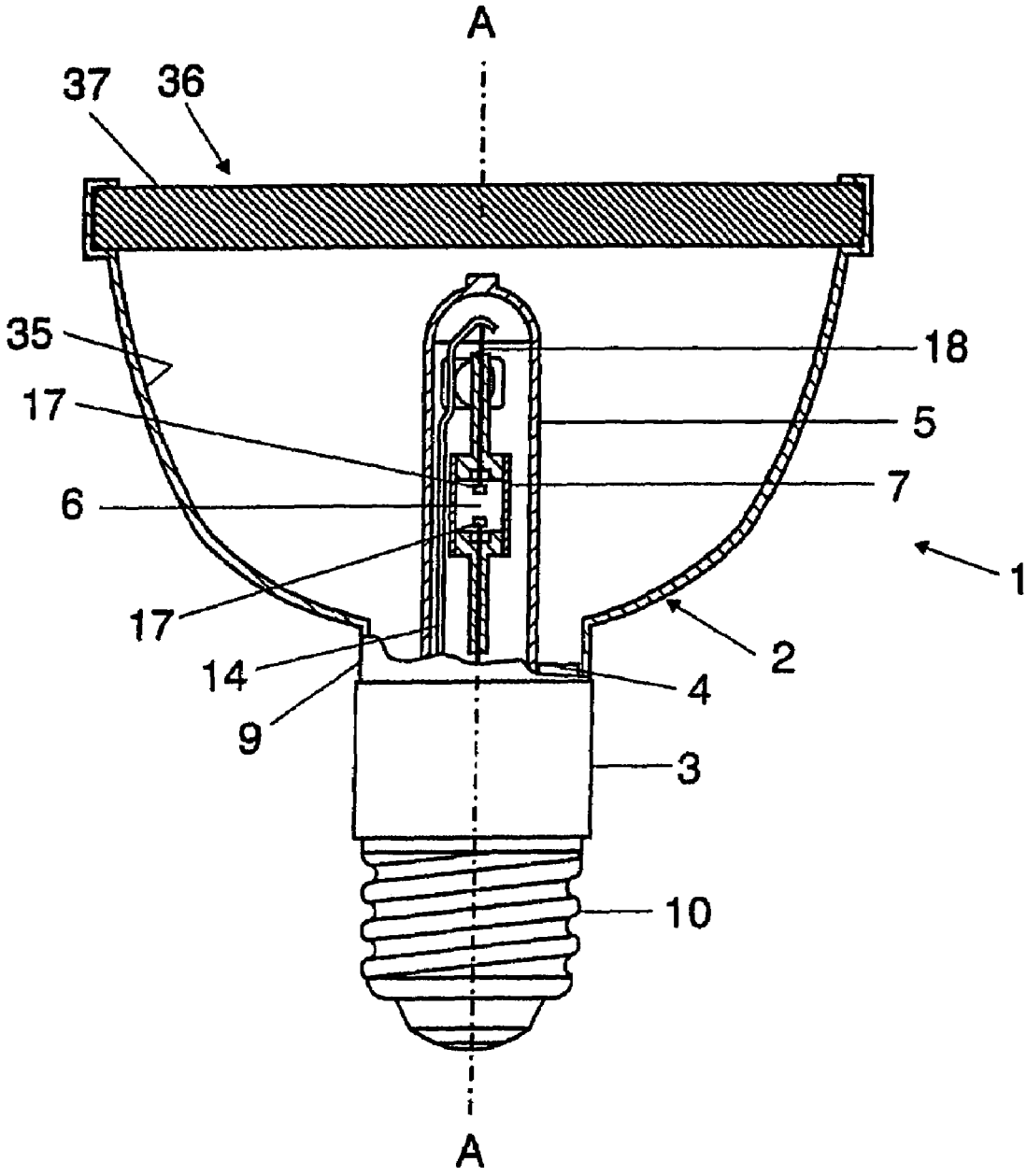
FIG. 1 shows a side view of a metal halide lamp.

FIG. 1 shows a reflector lamp 1 having a reflector part 2 which is produced from aluminum. A base insulator 3 of the lamp has a raised collar 4 on the inside which is cylindrical and partially surrounds an outer bulb 5 but ends below the discharge volume 6 of the discharge vessel 7. The neck 9 of the reflector is initially pushed over the collar 4. Then, fixing by means of crimping, i.e. pressing the neck 9 into holes in the collar 4 (not shown) is realized such that dents result. Three dents produced by crimping and distributed over the circumference are sufficient. Instead of continuous holes, superficial depressions are also sufficient.

The lamp in FIG. 1 is a metal halide lamp for general lighting purposes, whose filling may contain halides of Na, Sn, Ca, Tm, Tl, inter alia. The ceramic inner discharge vessel 7, which is sealed at two ends, is arranged in elongate form in the lamp axis A. It is tightly surrounded by the outer bulb 5, which is pinch-sealed at one end and is produced from hard glass. A frame 14 having a short and a long feed line 15, 16 holds the discharge vessel 7 in the outer bulb 5. The electrodes 17 in the interior of the discharge vessel are connected to the feed lines via leadthroughs 18. Said feed lines are connected to outer power supply lines in the region of a pinch seal, which seals the outer bulb 5. The pinch seal of the outer bulb rests in a matching opening in the base insulator 3 made from ceramic and is held there by a metal clip, as is known per se. The base is formed essentially from the base insulator 3 and a screw base part 10.

A reflector 2 is fitted on the outside around the outer bulb 5. It is divided into a section having a contour 35, a neck part 9, to which the base is fixed, resting on one end and the reflector opening 36, which is sealed by a simple cover disk 37, resting on the other end of said section.

Figure 2:
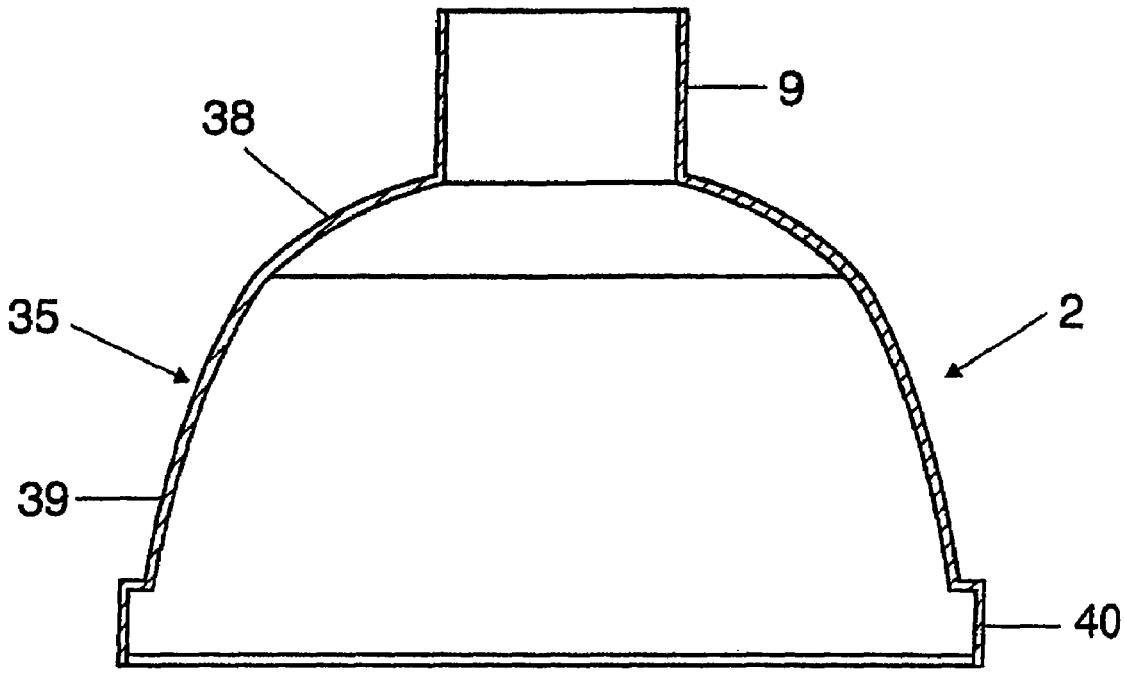
FIG. 2 shows a reflector for such a lamp.

FIG. 2 shows an enlarged illustration of the reflector 2. The contour 35 is divided into two zonal layers 38, 39, which are both in the form of free-form surfaces, which are rotationally symmetrical. The first zone 38 to be attached to the neck 9 is flat and has an average angle with respect to the lamp axis of approximately 70°, when using the central value between the start point and end point of the first zone. The second outer zone 39 is steep and has an average angle with respect to the lamp axis which is markedly less, by at least 20°, preferably by 30°. Its average angle with respect to the lamp axis A is approximately 35°, when using the central value between the start point and end point of the second zone. The second zone 39 ends at an enclosure 40, which later holds the cover disk by it being bent inwards.

Figure 3:
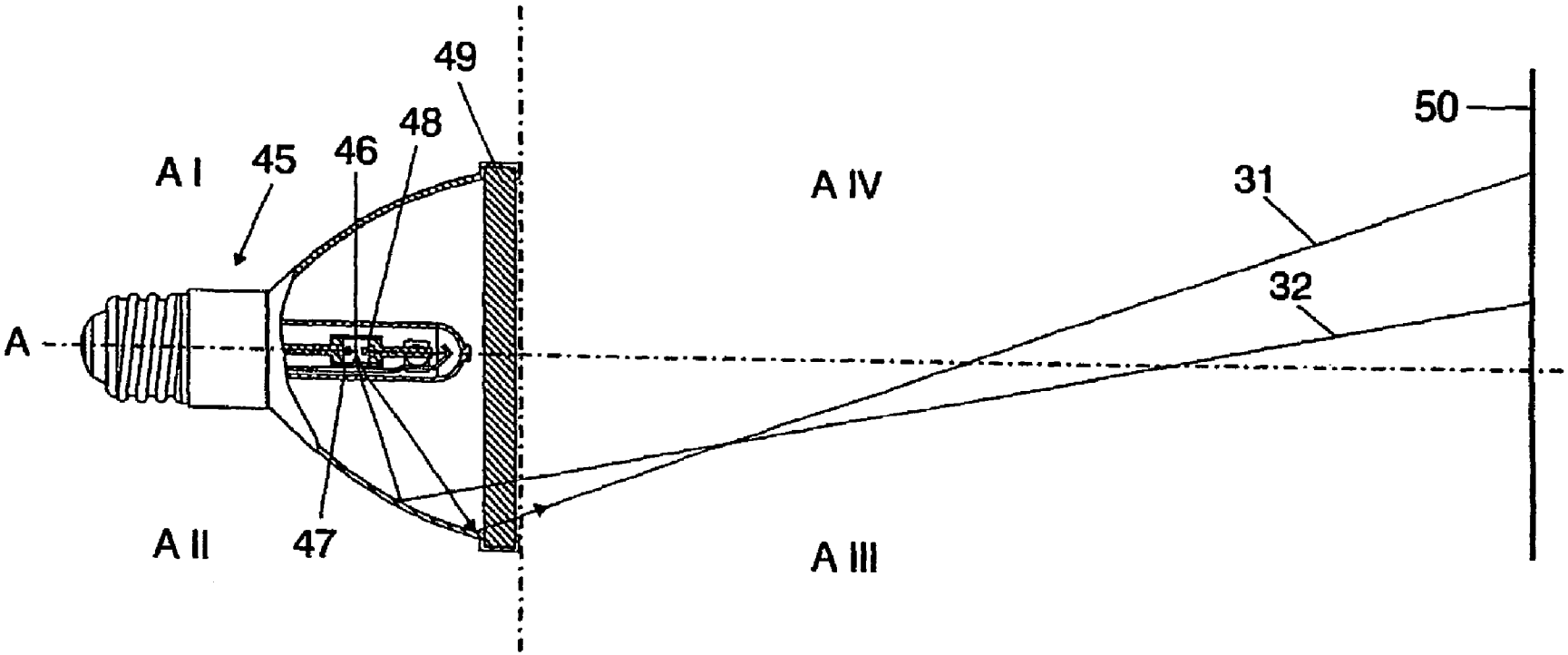
FIG. 3 PRIOR ART
FIG. 3 shows the operation of a previous reflector.
Figure 4:
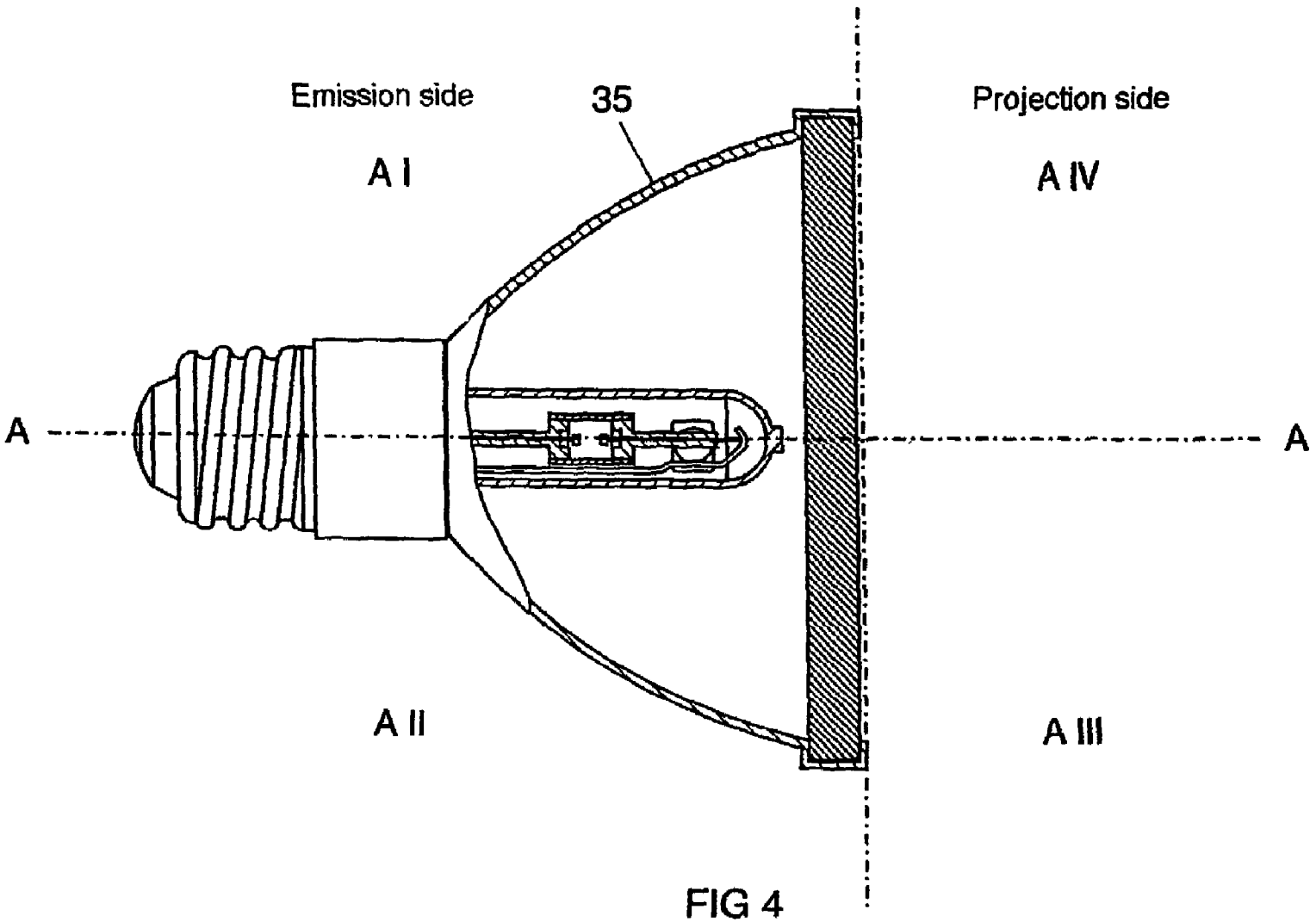
FIG. 4 shows the definition of the four quadrants.

The operation of a previous reflector is shown by way of example in FIG. 3. The reflector lamp 45 there is shown in vertical section in the horizontal operating position. A condensate 46 of the filling is deposited on the floor 47 of the discharge vessel 48. The lamp is divided into two symmetrical halves by the lamp axis A. The upper half is referred to as the first quadrant A I, and the lower half is referred to as the second quadrant A II. Radiation escapes from the center of the discharge vessel, where the discharge arc is, and downwards out of the discharge vessel 48. By definition, it is emitted into the second quadrant A II. The upper half of the lamp, by definition, is in the first quadrant A I. The first and second quadrants form the emission side, cf. FIG. 4. It ends at the cover disk 49. The projection side, in which in this case essentially only the far field is of interest, for example a projection plane 50 arranged vertically at a certain distance, begins behind the cover disk. The two other quadrants A III and A IV are here. By definition, the third quadrant A III is contained between the lower half of the cover disk 49 and the projection plane 50, while the fourth quadrant A IV lies above this, i.e. is contained between the upper half of the cover disk 49 and the projection plane 50. The principle of the quadrants is shown in FIG. 4.

Figure 5:
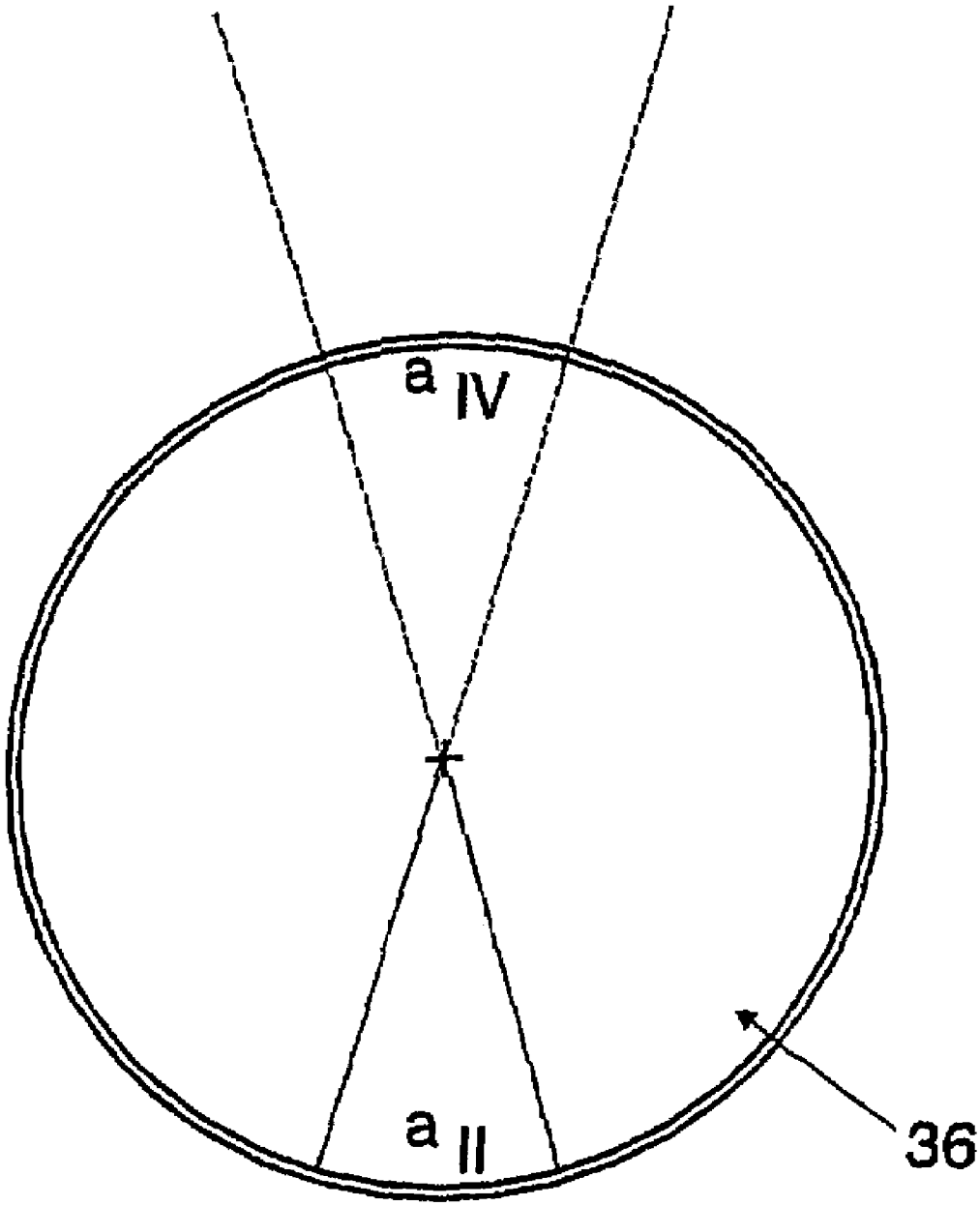
FIG. 5 PRIOR ART
FIG. 5 shows the assignment between the reflector segment and the radiating segment in a previous reflector.

FIG. 3 shows the connection between the emission side and the projection side in the prior art. Light from quadrant A I (not shown) is reflected into quadrant A III, while, correspondingly, light from quadrant A II, where the condensate 46 modifies the radiation, is reflected into quadrant A IV. By way of example, two light rays 31, 32 are shown. Light which emerges out of the discharge vessel through the condensate 46 into quadrant A II is radiated into the radiating segment $a_{IV}$ in the projection plane through the reflector segment $a_{II}$ (in the plan view in FIG. 5), as a result of which, at an average color temperature of 3000 K (integrally measured using the Ulbricht sphere), a radiating segment is produced on the projection plane which has, for example, a color temperature of approximately 2800 K. In analogy therewith, a radiating segment is produced in the lower projection plane which has a color temperature of approximately 3200 K since it originates from the quadrant I without any interference by the condensate 46. The color temperature has large local differences caused by a condensate and also by color fringes. The color effects thus produced are generally reduced by a patterned cover disk 49 fitted in the beam path.

Figure 6:
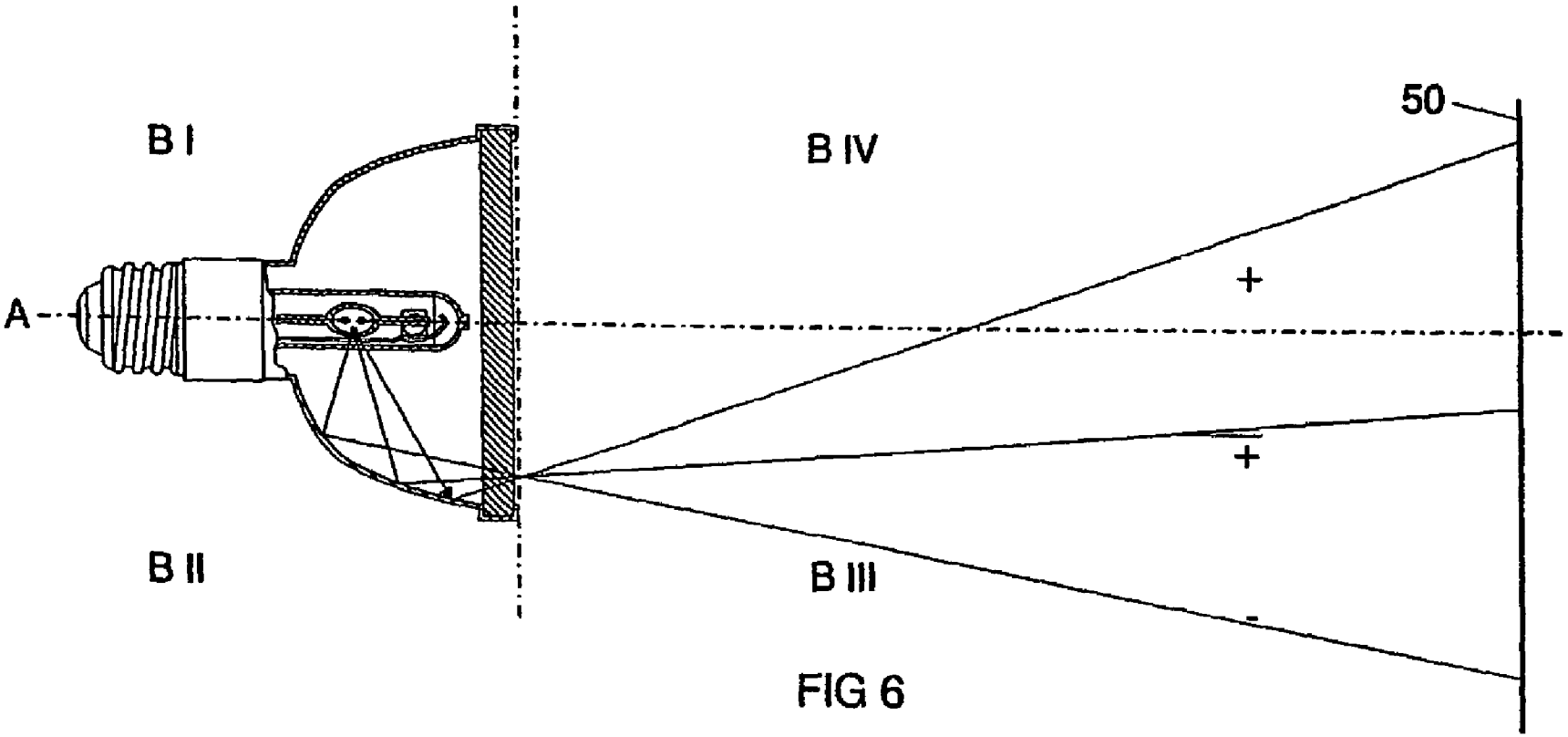
FIG. 6 shows the operation of a reflector in accordance with the invention.

In the case of the color-compensated reflector (FIG. 6), light having a low color temperature, which has settled mainly in a reflector segment which lies at the bottom in the horizontal operating position, i.e. at approximately 6 o'clock (cf. FIG. 7), i.e. in the second quadrant B II, is projected both into the fourth quadrant B IV at positive angles of reflection (symbolized by (+)) and into the third quadrant B III at negative angles (−).

Figure 7:
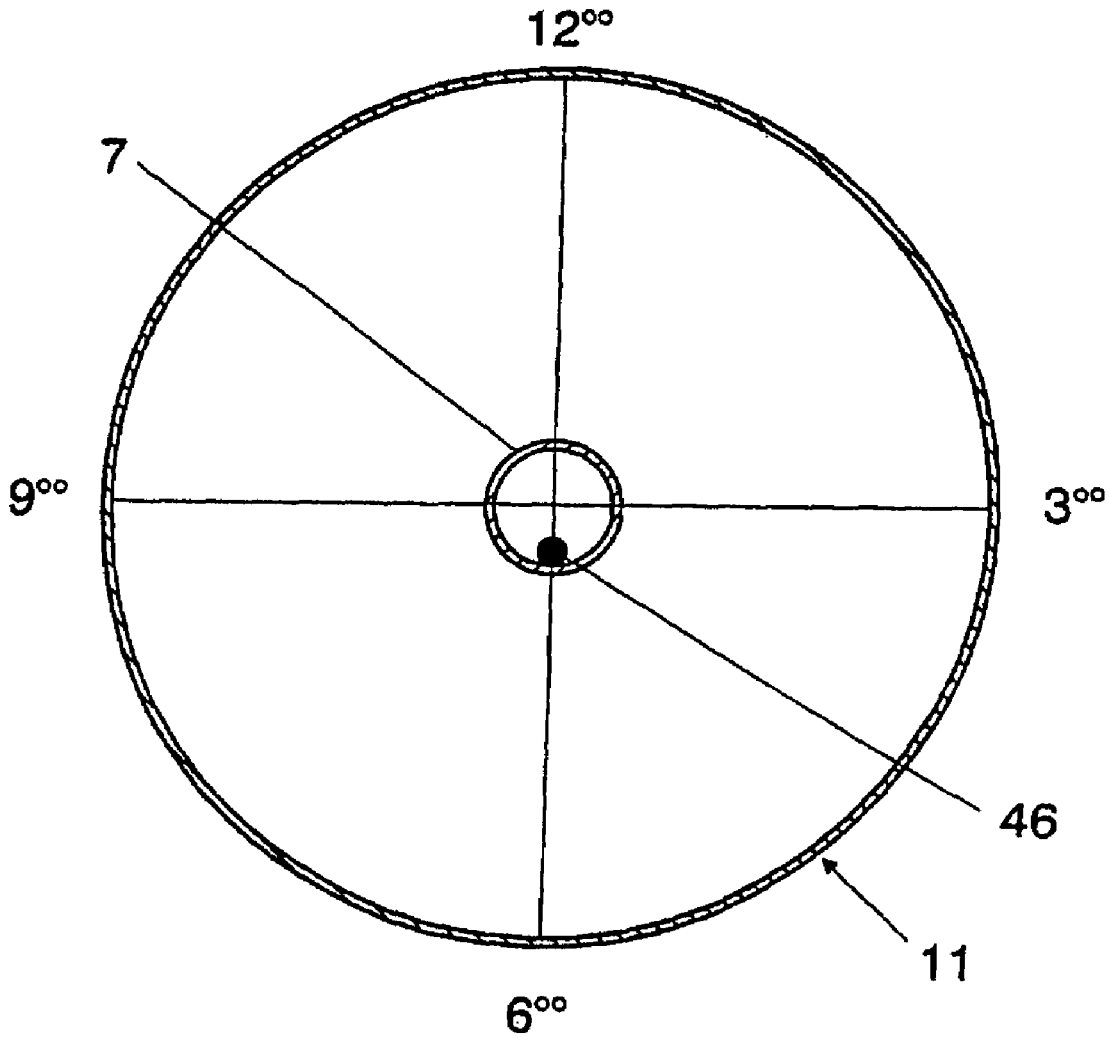
FIG. 7 shows the division of the reflector opening on the basis of clock times.

FIG. 7 shows the illustration with the clock times, the reflector opening 11 being marked along the circumference by clock times. 12 o'clock is at the top and 6 o'clock, i.e. the direction in which the condensate 46 is in the discharge vessel, is at the bottom. Conversely, the same applies to undisturbed light from the first quadrant B I. In each case approximately 50% of this light is also projected into the third quadrant (B III) and the fourth quadrant (B IV). Light having a low color temperature (reflector segment at 6 o'clock) is thus mixed with light having a high color temperature (reflector segment at 12 o'clock), while light having a medium color temperature (reflector segment at 3 o'clock) is again mixed with light having a medium color temperature (reflector segment at 9 o'clock) on the projection plane 50.

Figure 8:
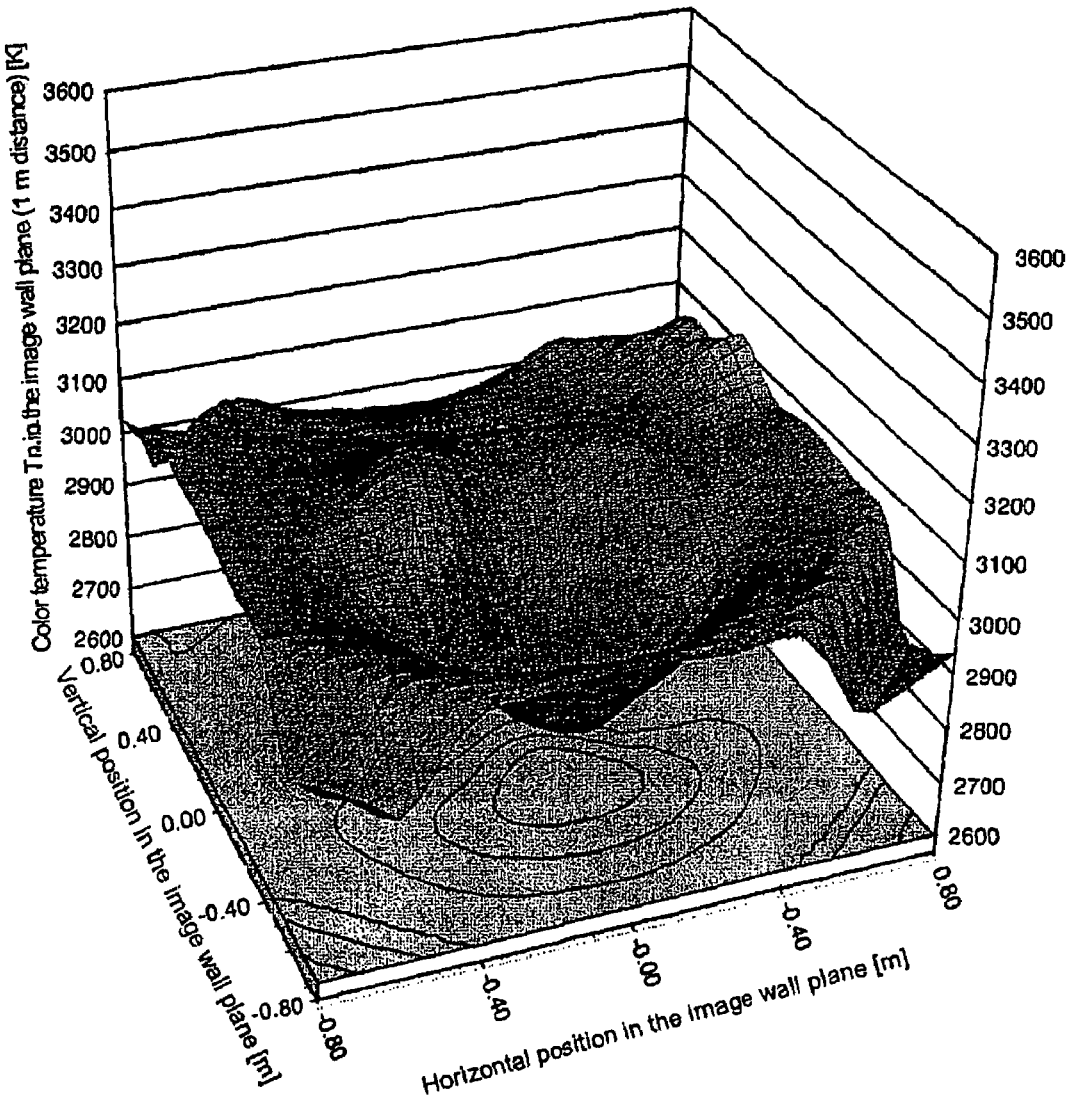
FIG. 8 PRIOR ART
FIG. 8 shows the scattering of the color temperature over the projection plane in the case of a previous reflector.
Figure 9:
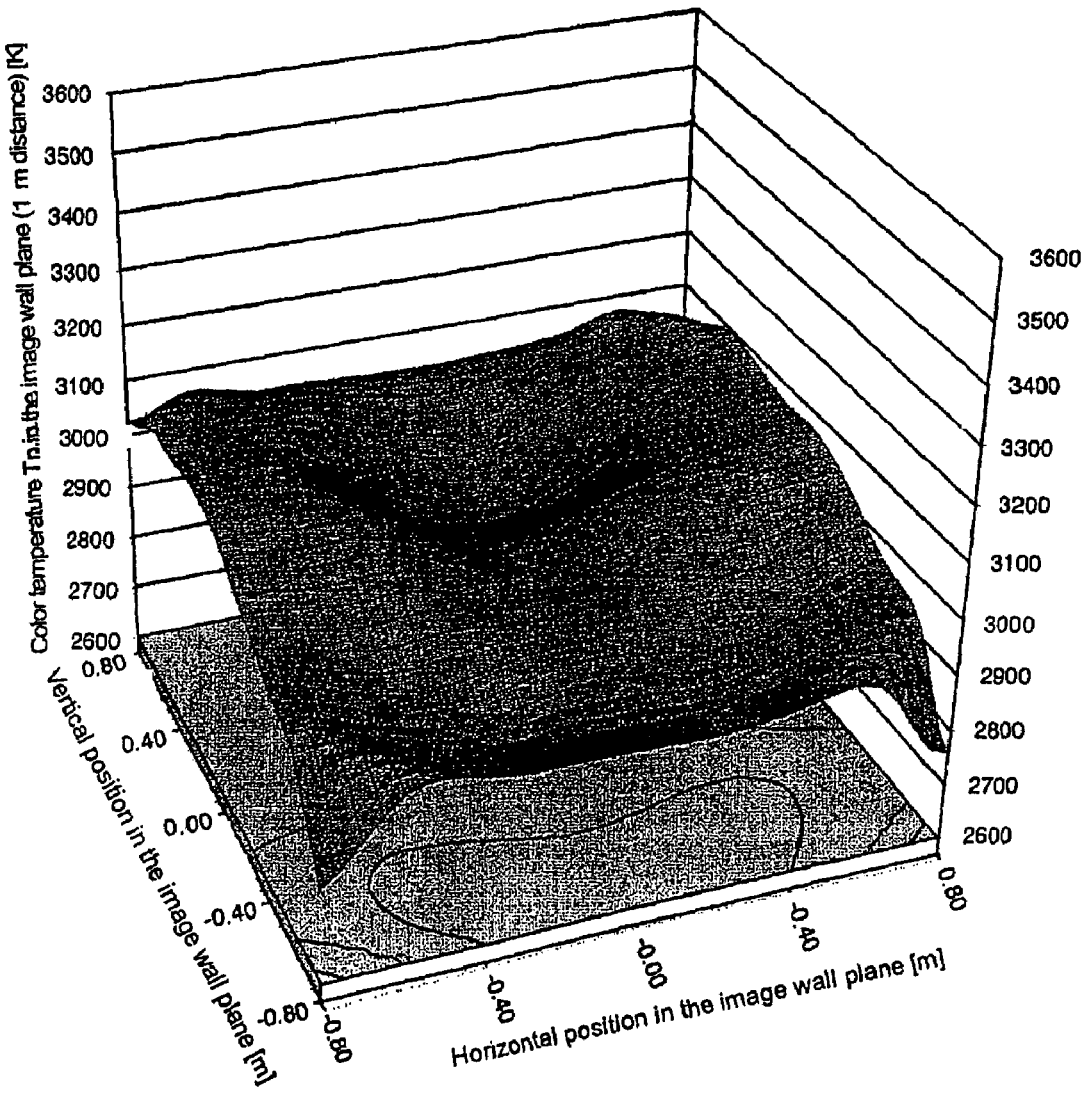
FIG. 9 shows the scattering of the color temperature over the projection plane in the case of a novel reflector.

In this manner, the resulting scattering of the color temperature over the projection plane 50 is considerably reduced in comparison with a conventional reflector. FIG. 8 shows the scattering of the color temperature of a lamp having a conventional, simple reflector, and FIG. 9 shows the considerably reduced scattering when using a novel reflector 2 composed of two zonal layers 38, 39 shown in FIG. 2.

The two zonal layers 38, 39 of the reflector mean that a reflector segment $b_{II}$ (FIG. 10) produces a radiating segment $b_{III}$ owing to its proportion on the flat reflector zone 38 and produces a radiating segment $b_{IV}$ in the projection plane owing to its proportion on the steep reflector zone 39 (indicated by dashed lines). These two radiating segments $b_{III}$ and $b_{IV}$, produced on the emission side by the reflector segment $b_{II}$, have, for example, a color temperature of 2800 K at an average color temperature of 3000 K and are superimposed with two practically identically localized radiating segments, but in this case produced by the reflector segment $b_I$ at a color temperature of, for example, 3200 K.

Figure 10:
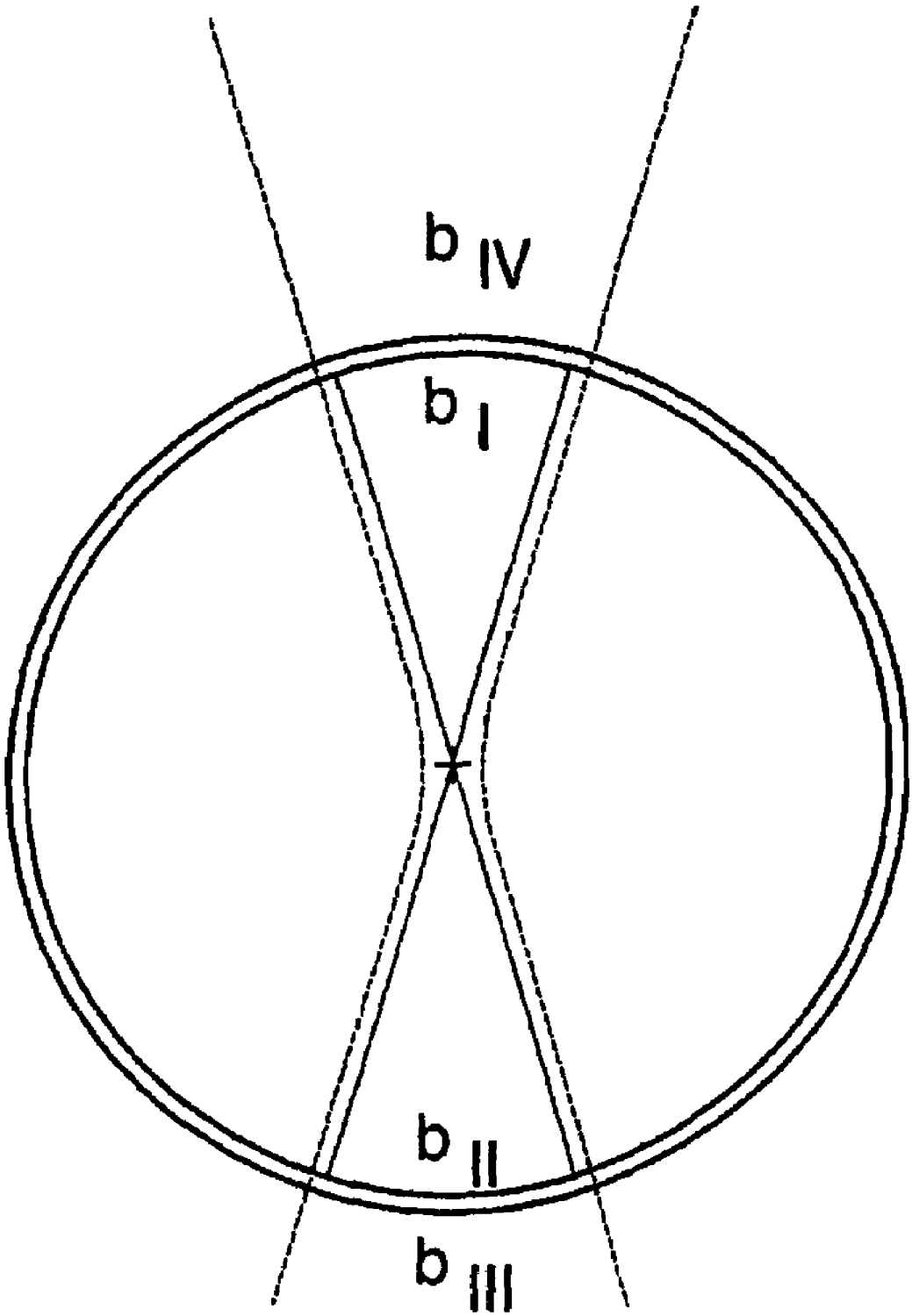
FIG. 10 shows the superimposition principle of a novel reflector.
Figure 11A:
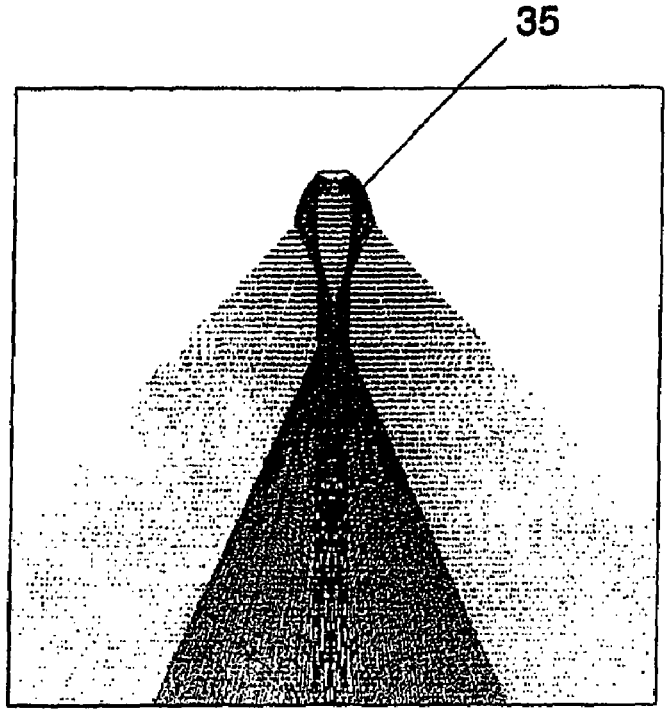
FIG. 11a PRIOR ART
FIG. 11 shows the beam path of a previous reflector lamp (FIG. 11*a*) and a novel reflector lamp (FIG. 11*b*).
Figure 11B:
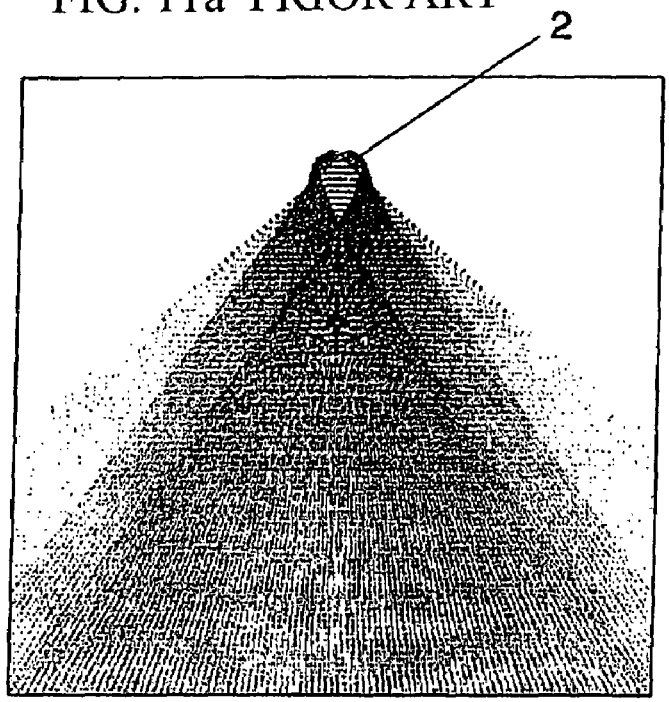

FIG. 11 shows the superimposition according to the invention of the emitted rays by the reflector 2 in illustration 11*b* in comparison to a beam path of a conventional reflector 49 in illustration 11*a*, in which practically no superimposition takes place, as described in FIG. 10.

In this manner, the variation of the color temperature in the projection plane may be considerably reduced, in particular by at least 50%.

In particular, a transition zone may also be inserted between the first and the second zonal layer, said transition zone avoiding a sharp kink between the two zones 38 and 39. In addition, an adaptation zone may also be provided between the first zonal layer 38 and the neck 9 and/or an adaptation zone may be provided between the second zonal layer and the rim of the reflector opening.

The contour of the reflector may be faceted in one or more of the zonal layers, as known per se, in order to improve uniformity further still.

Finally, the rim of the reflector can preferably be flanged (40) in the vicinity of the opening such that it holds the cover disk 37 directly. A separate holding mechanism (ring) can be dispensed with. This is possible in particular when using an aluminum reflector having a low wall thickness.

The invention claimed is:

1. A high-pressure discharge lamp with a base at one end, having an inner vessel which is sealed in a vacuum-tight manner, said inner vessel being surrounded by a reflector, and having a base, the inner vessel resting in a neck part of the reflector, characterized in that the reflector is of rotationally symmetrical design, and the reflector contour being divided into at least two zonal layers, whose axial height is dimensioned such that each zone captures at least 35% of the light intensity emerging from the center of the inner vessel, and a first zone reflecting back at least 90% of the light incident on it at positive angles in relation to the lamp axis, and a second zone reflecting back at least 90% of the light incident on it at negative angles in relation to the lamp axis, and the inner vessel containing a metal halide filling, and the lamp having a specified average color temperature.

2. The lamp as claimed in claim 1, characterized in that at least one zone is in the form of a free-surface contour.

3. The lamp as claimed in claim 1, characterized in that the second zone is also in the form of a free-surface contour.

4. The lamp as claimed in claim 1, characterized in that the inner vessel in the reflector is surrounded by an outer bulb.

5. The lamp as claimed in claim 1, characterized in that a flat-walled zone is attached to the neck part as a first zone, the average inclination of said flat-walled zone being 40 to 70° with respect to the lamp axis.

6. The lamp as claimed in claim 1, characterized in that a second more steeply walled zone is attached to the first zone, the average inclination of said more steeply walled zone being less than 30° with respect to the lamp axis.

7. The lamp as claimed in claim 1, characterized in that the reflector opening is either open or is closed by a cover disk without any visual effect.

8. The lamp as claimed in claim 1, characterized in that a transition zone is inserted between the first and the second zones of the contour.

9. The lamp as claimed in claim 1, characterized in that the reflector is produced from aluminum, the region of the reflector which is near to the rim holding a cover disk in the opening directly by means of flanging.

* * * * *